US006484660B1

(12) United States Patent
English

(10) Patent No.: US 6,484,660 B1
(45) Date of Patent: Nov. 26, 2002

(54) UNDERWATER NUCLEAR MATERIAL RECONNAISSANCE SYSTEM

(75) Inventor: Thomas P. English, Panama City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/942,168

(22) Filed: Aug. 30, 2001

(51) Int. Cl.[7] ..... B63G 8/00
(52) U.S. Cl. ..... 114/312; 114/337; 367/133
(58) Field of Search ..... 114/312, 313, 114/337, 221 R; 367/131, 133

(56) References Cited

U.S. PATENT DOCUMENTS 4,010,619 A * 3/1977 Hightower et al. ..... 114/322
4,686,927 A * 8/1987 Hawkes et al. ..... 114/312
5,579,285 A * 11/1996 Hubert ..... 367/133
6,359,834 B1 * 3/2002 English ..... 367/133
6,366,533 B1 * 4/2002 English ..... 367/131

* cited by examiner

*Primary Examiner*—Stephen Avila
(74) *Attorney, Agent, or Firm*—Harvey A. Gilberty; Donald G. Peck

(57) ABSTRACT

An underwater nuclear material reconnaissance system includes an underwater vehicle propelled/steered by a plurality of propulsion pods distributed thereabout. The underwater vehicle includes nuclear material sensors for generating sensor data indicative of the presence of nuclear material, a tunnel thruster for providing vertical thrust for the underwater vehicle, and a bi-directional communications cable deployable from the underwater vehicle. A remotely-located communications base station coupled to the bi-directional communications cable transmits control commands to the underwater vehicle and receives sensor data transmitted from the underwater vehicle.

18 Claims, 2 Drawing Sheets

10
12
14
14
20
22
24
26
28
28A
28A
30
30A
40
42
44
46
50
52
54
56
58
100
146
146
SELF-CONTAINED PROPULSION POD
SELF-CONTAINED PROPULSION POD
COMMUNICATIONS CABLE SPOOL ASSEMBLY
FIN/CONTROL SURFACE ASSEMBLY
INTERNAL ELECTRONICS AND POWER
VERTICAL THRUSTER
NUCLEAR MATERIAL SENSOR(S)
INVISIBLE LIGHT/CAMERA
GUIDANCE AND CONTROL
VIDEO CAMERA
OPERATOR CONTROL
TACTICAL DISPLAY
SONAR DISPLAY
VIDEO DISPLAY
COMMAND INPUT

UNDERWATER NUCLEAR MATERIAL RECONNAISSANCE SYSTEM

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to underwater reconnaissance, and more particularly to an unmanned underwater reconnaissance system capable of sensing the presence of nuclear materials in the water, on a vessel or in a harbor, and then relaying the sensed information back to a remote location.

BACKGROUND OF THE INVENTION

The examination or reconnaissance of underwater sites for the purposes of determining the presence of nuclear materials is necessary in a variety of military and civilian situations. For example, military situations include intelligence gathering regarding underwater vessels or harbors. Civilian situations include examination of waters surrounding a damaged or sunken vessel that is powered by or carries nuclear material, and reconnaissance of, for example, the water near a nuclear power plant. Typically, such nuclear material underwater reconnaissance is carried out by divers equipped with various underwater sensors, lights, cameras, etc., to examine an area of interest. However, this approach places divers in jeopardy of detection in the case of covert operations, exposure to nuclear radiation, and the general perils associated with deep sea diving.

SUMMARY OF THE INVENTION

Accordingly, it is an object of the present invention to provide a system for performing underwater reconnaissance with the goal of detecting the presence of nuclear material.

Another object of the present invention is to provide a nuclear material underwater reconnaissance system that is unmanned.

Still another object of the present invention is to provide an unmanned nuclear material underwater reconnaissance system that can be operated from a safe stand off distance.

Other objects and advantages of the present invention will become more obvious hereinafter in the specification and drawings.

In accordance with the present invention, an underwater nuclear material reconnaissance system utilizes a controllable underwater vehicle having a body and a plurality of propulsion pods distributed about and coupled to the body. Each propulsion pod has its own power source coupled to a propulsor. The underwater vehicle minimally incorporates nuclear material sensors for generating sensor data indicative of the presence of nuclear material, a tunnel thruster for providing vertical thrust for the underwater vehicle, and a bi-directional communications cable deployable from the underwater vehicle. A remotely-located communications base station coupled to the bi-directional communications cable transmits control commands to the underwater vehicle and receives sensor data transmitted from the underwater vehicle.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
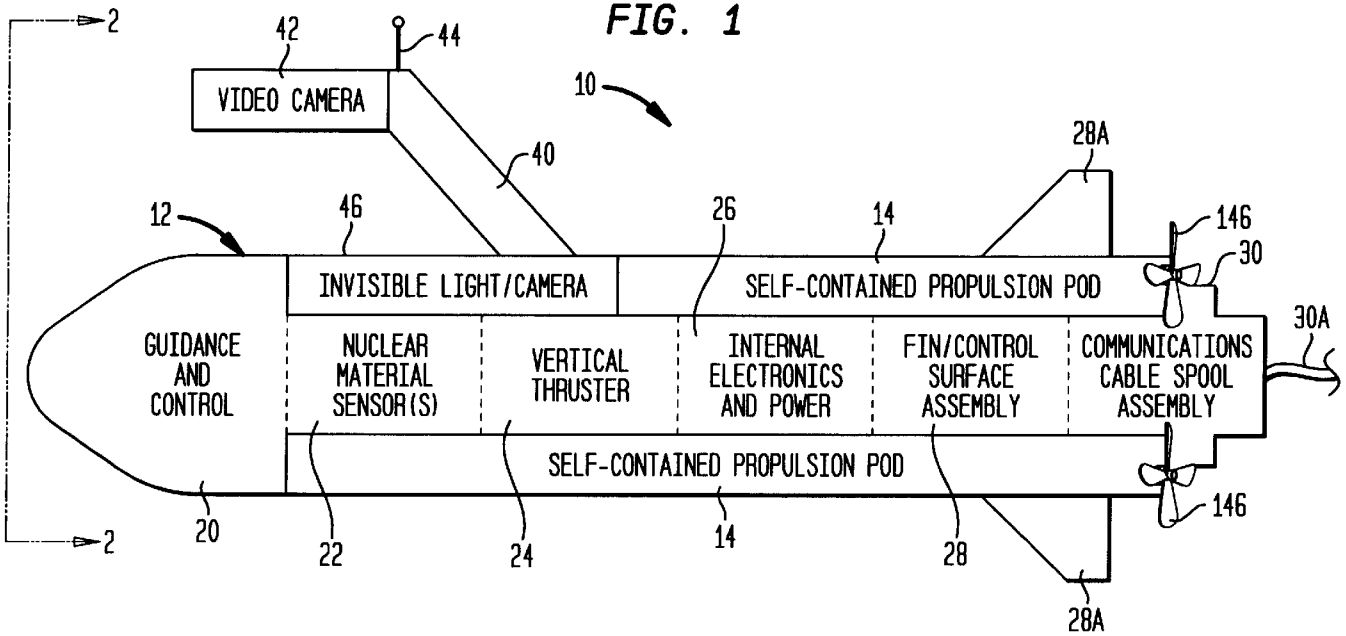
FIG. 1 is a schematic side view of the underwater vehicle used in the underwater nuclear material underwater reconnaissance system in accordance with the present invention.

Referring now to the drawings, and more particularly to FIG. 1, an unmanned underwater vehicle equipped for use in the present invention's underwater nuclear material reconnaissance system is shown and referenced generally by numeral 10. Underwater vehicle 10 can be used in both military and civilian reconnaissance applications in which an underwater area of interest is to be examined for the presence of nuclear material.

Underwater vehicle 10 includes a main body portion 12 extending from fore to aft and a number of self-contained propulsion pods 14 coupled to main body portion 12. Main body portion 12 can comprise an exterior housing for supporting a plurality functional modules to be described below. Alternatively, main body portion 12 can be formed by the plurality of functional modules, each of which could include a portion of an exterior housing such that main body portion 12 is formed when the modules are joined together.

Figure 3:
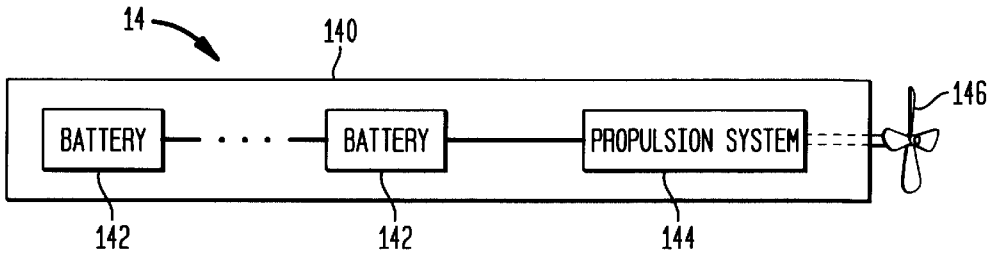
FIG. 3 is an isolated view of one of the underwater vehicle's self-contained propulsion pods.
Figure 2:
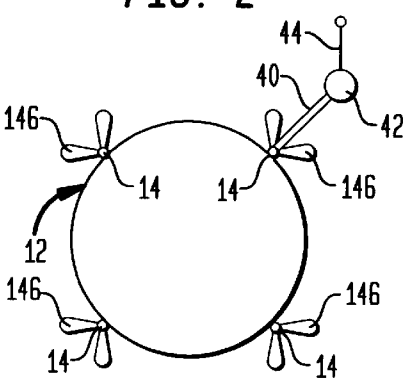
FIG. 2 is a front view of the underwater vehicle taken along line 2—2 in FIG. 1.

Self-contained propulsion pods 14 are typically distributed symmetrically about main body portion 12 as illustrated in FIG. 2 where four such propulsion pods 14 are shown. As illustrated in FIG. 3, each of propulsion pods 14 includes an external waterproof housing 140 and a plurality of batteries 142 that power a propulsion system 144 to include a propeller 146. The number and type of batteries used is not a limitation of the present invention.

The advantages of using multiple propulsion pods 14 in an underwater nuclear material reconnaissance system include the general advantage of making underwater vehicle 10 highly maneuverable as the speed of each propulsion pod can be individually controlled. For purposes of the present invention, this means that the nuclear material sensors (contained in module 22) can be optimally positioned at all times thereby minimizing the number of sensing "passes" required and minimizing the amount of time that underwater vehicle 10 must be on a site that is either potentially dangerous or hostile.

As mentioned above, main body portion 12 incorporates a number of functional modules for carrying out a nuclear material reconnaissance mission. A guidance and control module 20 would typically include a sonar system (not shown) and use sonar data to assist in the route guidance of vehicle 10. The route guidance commands can be supplied manually/remotely or stored internally as will be explained further below. Nuclear material sensor(s) module 22 is provided to detect the presence of nuclear material which is typically in the water or onboard a vessel in the water. Further, in the case of extremely sensitive sensors or large amounts of nuclear material, sensor module 22 might also be able to detect the presence of nuclear material on dry land in a harbor. Such nuclear material sensors are well known in the art and will not be described further herein. A vertical thruster module 24 is provided in the central area of main body portion 12 so that underwater vehicle 10 can hover and quickly adjust its vertical position in the water. Typically, vertical thruster module 24 is a tunnel thruster, the particular design of which is not a limitation of the present invention. Various electronic systems and power supporting the modules in main body portion 12 are contained in an internal electronics and power module 26. A fin/control surface assembly module 28 provide the necessary fins/control surfaces 28A needed to manipulate underwater vehicle 10 as it is propelled through the water. A communication cable spool assembly module 30 houses a communications cable 30A that is paid out during deployment of underwater vehicle 10. Cable 30A should be capable of bi-directional communication and is typically a fiber optic cable.

For improved navigation and/or intelligence gathering, underwater vehicle 10 can be equipped with additional systems. For example, one of propulsion pods 14 can incorporate imaging capability. More specifically, one of propulsion pods 14 can have an extension arm 40 coupled thereto. Arm 40 should extend radially out from main body portion 12 such that underwater vehicle 10 can run in the water while the outboard end of arm 40 extends out of the water. Mounted on the end of arm 40 is a video camera 42 so that underwater vehicle 10 can generate an above-water video image. A GPS antenna 44 can also be attached to arm 40 and provide GPS signals to guidance and control module 20.

Another system that can be included as part of underwater vehicle 10 is a low-light condition imaging system. More specifically, one of propulsion pods 14 can incorporate an invisible light source/camera 46 capable of illuminating a low-light or no-light area of interest with invisible light and then imaging the area with a camera sensitive to the same invisible light. Although shown associated with the same propulsion pod 14 as video camera 42, this need not be the case.

Figure 4:
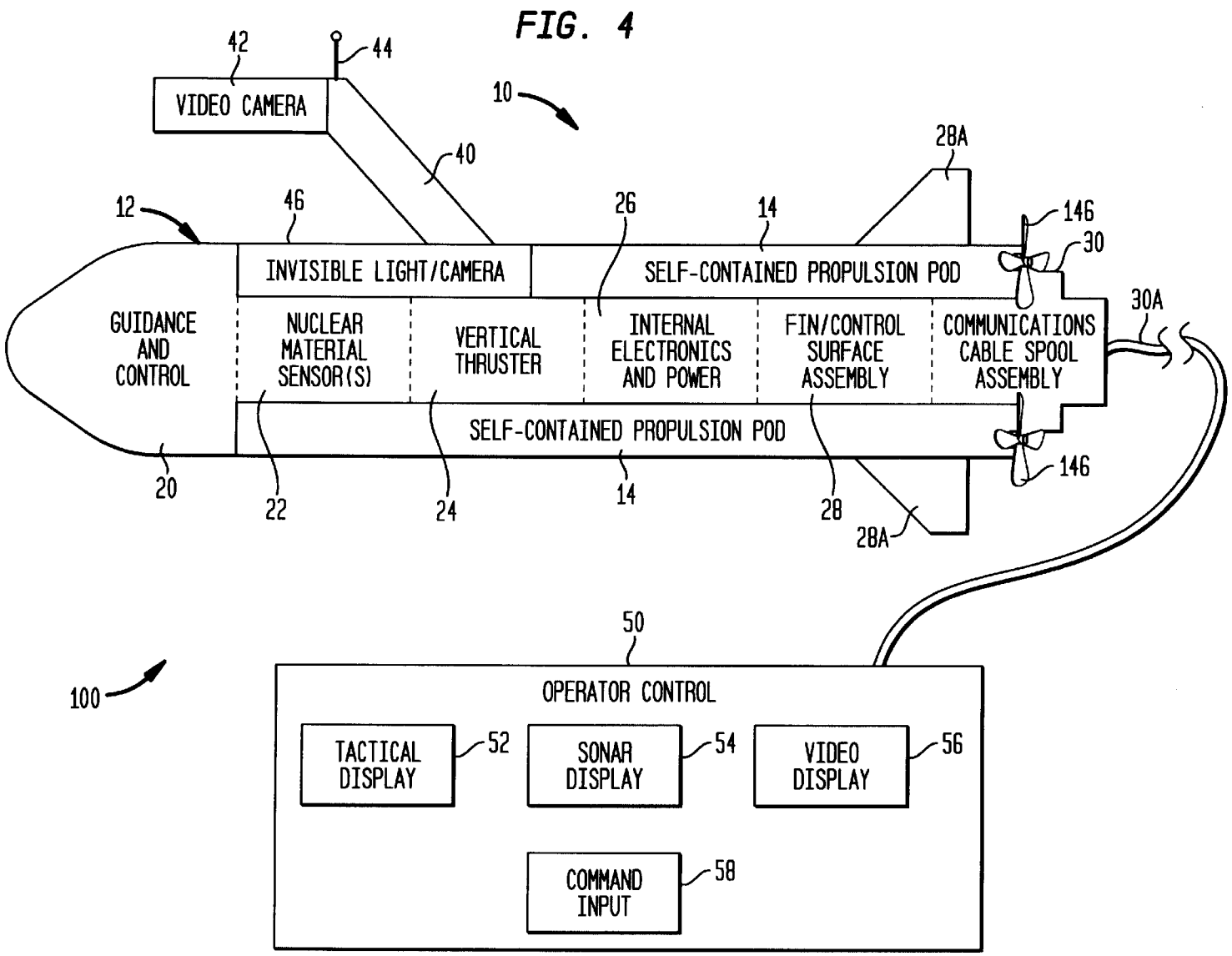
FIG. 4 is a schematic side view of the underwater nuclear material underwater reconnaissance system according to the present invention.

The complete underwater nuclear material reconnaissance system according to the present invention will now be explained with the aid of FIG. 4 where the system is referenced generally by numeral 100. System 100 includes underwater vehicle 10 described above and a remotely-located operation control base station 50 which is typically located onboard a vessel or other platform (not shown) that launches/deploys underwater vehicle 10. Base station 50 is manned/operated by personnel controlling and/or using underwater vehicle 10. Accordingly, base station 50 includes a number of displays such as tactical display 52, sonar display 54 and video display(s) 56. Control commands for underwater vehicle 10 are input using a command input device 58 (e.g., keyboard, touch screen, voice activated controls, etc.)

In operation, underwater vehicle 10 is launched from a vessel/platform and directed to an underwater destination. As mentioned above, route guidance implemented by guidance and control module 20 can be pre-programmed, controlled manually from base station 50, or be implemented by a combination of pre-programmed and manual maneuvers. For example, a pre-programmed route guidance could be used until vehicle 10 covered a certain distance (or was out for a specified time), at which point manual control of vehicle 10 could be used. For both pre-programmed and manual route guidance, guidance and control module 20 issues control commands to propulsion systems 144, vertical thruster module 24 and fin/control surface assembly module 28. While in route, GPS data and image data from cameras 42 and 46 can be transmitted over cable 30A to base station 50. More specifically, vehicle attitude/location and target location are displayed on tactical display 52 while sonar data can be displayed on sonar display 54. Image data can be displayed on video display(s) 56. Once in position for performing nuclear material reconnaissance, nuclear material sensor(s) module 22 is activated and underwater vehicle 10 is moved to inspect an area of interest. Sensor data gathered by module 22 is transmitted over cable 30A to base station 50.

The advantages of the present invention are numerous. The unmanned underwater nuclear material reconnaissance system will allow a dangerous underwater environment to be inspected from a safe stand off distance. The system can be used in covert military operations as well as civilian operations. The use of multiple propulsion pods allows the use of smaller batteries which are drawn down at a slower rate than larger batteries used in conventional underwater propulsion systems. Thus, the present invention can be used in longer missions and at greater stand off ranges than conventional underwater vehicles.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. An underwater nuclear material reconnaissance system, comprising:

a controllable underwater vehicle having a body and a plurality of propulsion pods distributed about and coupled to said body, each of said plurality of propulsion pods having a power source coupled to a propulsor;

at least one extension arm coupled to one of said plurality of propulsion pods and extending radially away from said body;

an imaging device mounted on said extension arm for generating video image data;

a GPS antenna mounted on said extension arm for receiving GPS data;

said underwater vehicle incorporating nuclear material sensors for generating sensor data indicative of the presence of nuclear material, a tunnel thruster for providing vertical thrust for said underwater vehicle, and a bi-directional communications cable deployable from said underwater vehicle; and a remotely-located communications base station coupled to said bi-directional communications cable for transmitting control commands to said underwater vehicle and for receiving data transmitted from said underwater vehicle, wherein said data transmitted from said underwater vehicle includes said GPS data, said video image data and said sensor data.

2. An underwater nuclear material reconnaissance system as in claim 1 further comprising a second imaging device coupled to one of said propulsion pods for generating image data in low-light conditions.

3. An underwater nuclear material reconnaissance system as in claim 2, wherein said second imaging device is sensitive to non-visible light energy, said system further comprising a non-visible light source for illuminating an image area of said second imaging device with said non-visible light energy.

4. An underwater nuclear material reconnaissance system as in claim 1 wherein said plurality of propulsion pods comprises four propulsion pods.

5. An underwater nuclear material reconnaissance system as in claim 1 further comprising a spool assembly coupled to said underwater vehicle for housing said bi-directional communications cable.

6. An underwater nuclear material reconnaissance system as in claim 1 wherein said bi-directional communications cable is a fiber optic cable.

7. An underwater nuclear material reconnaissance system as in claim 1 wherein said communications base station includes display means for displaying said GPS data, said video image data and said sensor data.

8. An underwater nuclear material reconnaissance system as in claim 1 wherein said power source in each of said plurality of propulsion pods comprises at least one battery.

9. An underwater nuclear material reconnaissance system, comprising:

a controllable underwater vehicle having a body and a plurality of propulsion pods distributed symmetrically about and coupled to said body, each of said plurality of propulsion pods having a power source coupled to a propulsor;

at least one extension arm coupled to one of said plurality of propulsion pods and extending radially away from said body;

an imaging device mounted on said extension arm for generating video image data;

a GPS antenna mounted on said extension arm for receiving GPS data;

said body defined by a plurality of modular sections to include a guidance and control section for controlling navigation of said underwater vehicle, a sensor section for generating sensor data indicative of the presence of nuclear material, a vertical thrust section for generating vertically-directed thrust for said underwater vehicle, a cable storage section for housing a deployable bi-directional communications cable, and a power section for supplying power to each of said guidance and control section, said sensor section, said vertical thrust section and said cable storage section; and a remotely-located communications base station coupled to said bi-directional communications cable for transmitting control commands to said underwater vehicle and for receiving data transmitted from said underwater vehicle, wherein said data transmitted from said underwater vehicle includes said GPS data, said video image data and said sensor data.

10. An underwater nuclear material reconnaissance system as in claim 9 further comprising a second imaging device coupled to one of said propulsion pods for generating image data in low-light conditions.

11. An underwater nuclear material reconnaissance system as in claim 10, wherein said second imaging device is sensitive to non-visible light energy, said system further comprising a non-visible light source for illuminating an image area of said second imaging device with said non-visible light energy.

12. An underwater nuclear material reconnaissance system as in claim 9 wherein said plurality of propulsion pods comprises four propulsion pods.

13. An underwater nuclear material reconnaissance system as in claim 9 wherein said bi-directional communications cable is a fiber optic cable.

14. An underwater nuclear material reconnaissance system as in claim 9 wherein said communications base station includes display means for displaying said GPS data, said video image data and said sensor data.

15. An underwater nuclear material reconnaissance system as in claim 9 wherein said power source in each of said plurality of propulsion pods comprises at least one battery.

16. An underwater nuclear material reconnaissance system, comprising:

a controllable underwater vehicle having a body and a plurality of propulsion pods distributed about and coupled to said body, each of said plurality of propulsion pods having a power source coupled to a propulsor;

said underwater vehicle incorporating nuclear material sensors for generating sensor data indicative of the presence of nuclear material, a tunnel thruster for providing vertical thrust for said underwater vehicle, and a bi-directional communications cable deployable from said underwater vehicle; and a remotely-located communications base station coupled to said bi-directional communications cable for transmitting control commands to said underwater vehicle and for receiving said sensor data transmitted from said underwater vehicle.

17. An underwater nuclear material reconnaissance system as in claim 16 wherein said plurality of propulsion pods comprises four propulsion pods distributed symmetrically about said body.

18. An underwater nuclear material reconnaissance system as in claim 16 wherein said power source in each of said plurality of propulsion pods comprises at least one battery.

* * * * *